US005314315A

United States Patent [19]

Tcholakov

[11] Patent Number: 5,314,315

[45] Date of Patent: May 24, 1994

[54] HYDRAULIC PUMP OUTPUT PRESSURE COMPENSATION SYSTEM

[76] Inventor: Stoil M. Tcholakov, 1913 W. Lamar, Houston, Tex. 77019

[21] Appl. No.: 888,354

[22] Filed: May 21, 1992

[51] Int. Cl.[5] ..... E04B 11/00

[52] U.S. Cl. ..... 417/540

[58] Field of Search ..... 417/540, 542

[56] References Cited

U.S. PATENT DOCUMENTS

| | | | |
|---|---|---|---|
| 1,846,483 | 2/1932 | Gilbert | 417/540 |
| 2,430,723 | 11/1947 | Lupfer | 417/540 |
| 4,201,734 | 5/1980 | Ohnishi | 417/540 |
| 4,646,782 | 3/1987 | Ezekoye | 417/540 |
| 5,036,879 | 8/1991 | Ponci | 417/540 |

FOREIGN PATENT DOCUMENTS

| | | | |
|---|---|---|---|
| 688609 | 6/1964 | Canada | 417/540 |
| 3249385 | 11/1991 | Japan | 417/540 |
| 891635 | 3/1962 | United Kingdom | 417/540 |

*Primary Examiner*—Richard A. Bertsch
*Assistant Examiner*—Peter Korytnyk
*Attorney, Agent, or Firm*—Pravel, Hewitt, Kimball & Krieger

[57] ABSTRACT

A high pressure hydraulic pump output compensator which utilizes a free-floating piston in a closed cylinder forming a lower and an upper chamber. One end of the cylinder is connected to the input of a hydraulic pump operating in excess of 1,000 psi. The lower chamber further includes a hydraulic input and an output port. Compressed air is provided to the free-floating piston at the opposite end of the chamber which exerts a force downwardly on the free-floating piston. The output pressure from the hydraulic pump compresses the air within the cylinder until such time as the compressed air and water pressure are equalized. As the output from the hydraulic pump drops during its working cylinder, the compressed air forces the piston downward to maintain the hydraulic output pressure.

5 Claims, 3 Drawing Sheets

HYDRAULIC PUMP OUTPUT PRESSURE COMPENSATION SYSTEM

BACKGROUND OF THE INVENTION

The present invention is directed to an apparatus for providing constant hydraulic output pressure from a pump, more particularly, to a pressure compensation means for a piston driven hydraulic pump.

1. Field of the Invention

The use of hydraulic pumps, in particular, piston driven or rotary hydraulic pumps, to provide high pressure water is well known in the art. The hydraulic piston pumps may be driven by pneumatic pressure, internal combustion engines, electric motors, or other means. Pneumatic hydraulic pumps are often capable of developing output pressures in excess of thirty times the pneumatic pressure supplied. Thus, a hydraulic pump having a 100 psi air pressure supply may be capable of developing a hydraulic pressure of 3,000 psi or greater. However, the design of a piston driven pump includes a known problem in that the pump does not develop any significant pressure at the piston top dead point (TDP) and bottom dead point (BDP). Thus, the hydraulic pump is not working during the entire piston travel cycle.

Further, the piston hydraulic pump also suffers from a problem known as hydraulic shock when the piston face comes into contact with the water after reaching each dead point. This hydraulic shock can result in an excessive wear to the hydraulic pump and any connecting lines to the pump thereby increasing the safety risk for the pump, operator and any downstream systems.

Prior art includes various mechanisms for eliminating hydraulic shock and for regulating pump output pressures to provide for a relatively constant pressure supply. These systems include the Hydrophor water supply systems which are commonly utilized in maritime vehicles. In the Hydrophor system, a water pump fills a closed container approximately two-thirds full of water and automatically switches off. The top end of the container is connected to a compressed air supply which maintains air pressure at a set level in the container. As the hydraulic pump begins filling the container with water, the air at the top of the container is compressed. When the amount of water in the container decreases, the hydraulic pressure within the container also decreases. The compressed air within the container forces the water downwardly, thereby compensating for the loss in hydraulic pressure from the pump. Thus, the Hydrophor system utilizing compressed air and hydraulic pressure maintains a water pressure in the range of 30–80 psi.

Another known system for maintaining relatively constant output pressure is through use of a small vessel having two chambers separated by a flexible diaphragm. One chamber is filled with compressed air while the other chamber is filled with the working pressurized liquid. As in the Hydrophor system, the diaphragm is displaced by pressurized water, thereby pressurizing the air in the other chamber. As the hydraulic pressure decreases, the air pressure deforms the diaphragm into the water chamber, partially compensating for the loss in hydraulic pressure.

The above systems, however, are not suitable in high pressure hydraulic applications. In the Hydrophor system, there is direct contact between the air and the water, which absorbs the compressed air. As the water pressure increases, the absorption of air within the water is greater. To compensate for this increased absorption of air, the air pressure itself must be increased. This requires a container having a thicker wall to compensate for the increased pressure.

The second mechanism, which utilizes a diaphragm, does not have the problem of air absorption because there is no air/water interface. However, this mechanism is unsuitable for use at high hydraulic pressures. The air chamber must be filled with an air pressure almost equal to the working water pressure. This requires higher air pressure which increases energy consumption and places significant material requirements on the diaphragm itself. The diaphragm must be elastic and thin to deform sufficiently to permit the compressed air to compensate for the drop in hydraulic pressure, but at the same time, be strong enough to withstand the high pressures. Further, this second type of mechanism has limited diaphragm deformation, thus decreasing the ability of the air chamber to compensate for the drop in hydraulic pressure.

Thus, there exists a need for a high pressure output compensation system, utilizing relatively low air pressure, which is capable of maintaining relatively constant high hydraulic pressures from a piston-driven pump.

SUMMARY OF THE INVENTION

The present invention relates to a hydraulic pump output pressure compensation device for use in systems utilizing high pressure piston driven hydraulic pumps. The present invention is comprised of a high pressure cylinder having a free-floating piston therein. The one end of the cylinder is connected to the output of the hydraulic pump through an inlet valve. The same end of the cylinder further includes a high pressure outlet valve and water discharge outlet. The other end of the cylinder is connected to a compressed air source through a compressed air inlet and check valve. As the high pressure water enters the cylinder, some of the water is retained within the cylinder, displacing the free-floating piston towards the compressed air inlet, thereby further increasing the air pressure within that portion of the cylinder. As the hydraulic pump output pressure from the hydraulic pump decreases when it reaches either the TDP or BDP, the hydraulic force exerted on the free-floating piston decreases and the compressed air in the compressed air portion of the cylinder expands to move the free-floating piston to compress the water, thereby increasing the output pressure of the water from the cylinder. The present invention thus assures a continuous flow of high pressure liquid, increasing the pump's efficiency, while it absorbing the hydraulic shock effects created by the pump. Further, the present invention does not require an excessively high air pressure to compensate for the hydraulic pump output pressure variances as there is no air/water interface.

The present invention may be used in high hydraulic pressure applications such as sand blasting or cleaning. However, it will be appreciated that the present invention may be utilized in any application which requires a relatively high, constant pressure output.

BRIEF DESCRIPTION OF THE DRAWINGS

A better understanding of the present invention can be obtained when the following detailed description of the exemplary embodiments is considered in conjunction with the following drawings, in which.

DESCRIPTION OF THE PREFERRED EMBODIMENT

Figure 1:
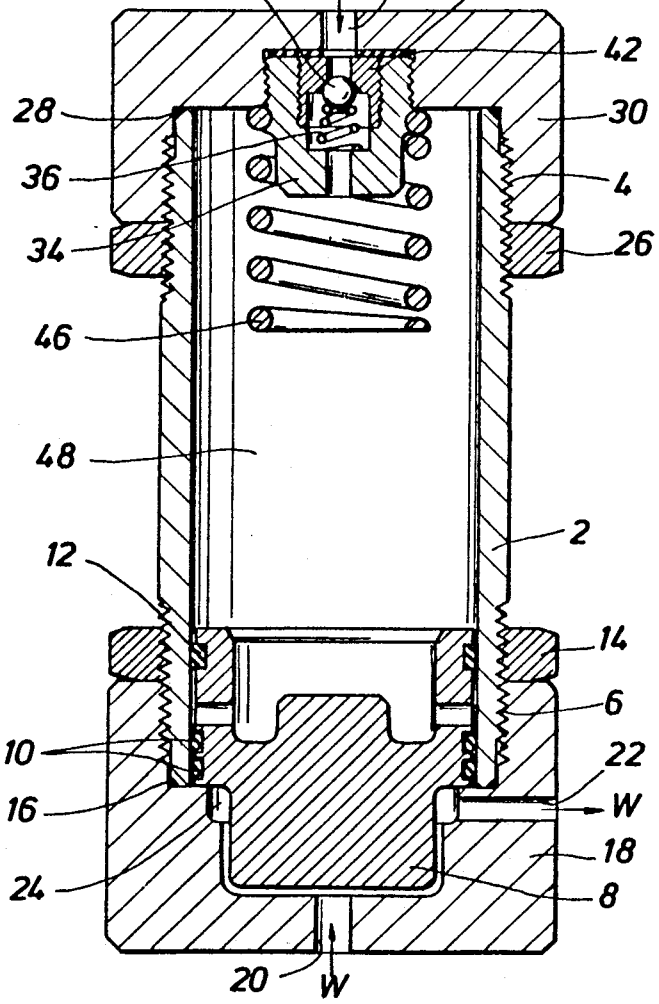
FIG. 1 is a cross sectional view of the preferred embodiment of the claimed invention.

The present invention is directed to an output pressure compensator means for a high pressure hydraulic pump. FIG. 1 is a cross-sectional diagram of the preferred embodiment of the claimed invention. The compensator of the preferred embodiment is comprised of a hollow cylinder 2 having external threads 4 and 6 at the cylinder 2 top and bottom. A free-floating piston 8, having two compression seal rings 10 mounted thereabout, is inserted in the cylinder 2. It will be appreciated that the number of seal rings 10 may vary within the claimed invention. The piston 8, further includes a lower pressure guide ring 12 disposed thereabout. A safety nut 14, having mating threads, is threaded onto the cylinder 2 bottom followed by a sealing gasket 16 and a bottom cap 18. The safety nut 14 is brought into abutment with the bottom cap 18, thereby providing a high pressure seal for cylinder 2. The bottom cap 18 further includes a threaded water inlet 20 and a water outlet 22 adapted to relieve hydraulic pressure lines. The outlets are in fluid communication with the water chamber 24 within cylinder 2.

The preferred embodiment further includes a safety nut 26 threaded onto the top of the cylinder 2, followed by a sealing gasket 28 and a threadedly mating top cap 30. The safety nut 26 is brought into abutment with the top cap 30 to provide a high pressure pneumatic seal. The top cap 30 further includes a threaded compressed air inlet 32 and a check valve 34, 10 comprised of a spring 36, ball 38 and body 40, adapted to be retained within the top cap 30. In the preferred embodiment of FIG. 1, a sealing gasket 42 is inserted into a threaded cavity within the top cap 30. The check valve 34, is threadedly mated with the top cap 30 to provide an air-proof seal between the check valve 34 and the cylinder 2.

A coiled piston spring 46 is inserted over and retained about check valve 34. The piston spring 46 operates to overcome initial inertia of the piston 8 and provide additional resistance to the hydraulic forces acting on the free-floating piston 8. FIG. 1 illustrates the free-floating piston 8 as having been fully indexed to the bottom of cylinder 2. This forms an air pressure chamber 48 in which compressed air entering through air inlet 32 and check valve 34 has overcome the hydraulic pressure of the water in water chamber 24.

Figure 2:
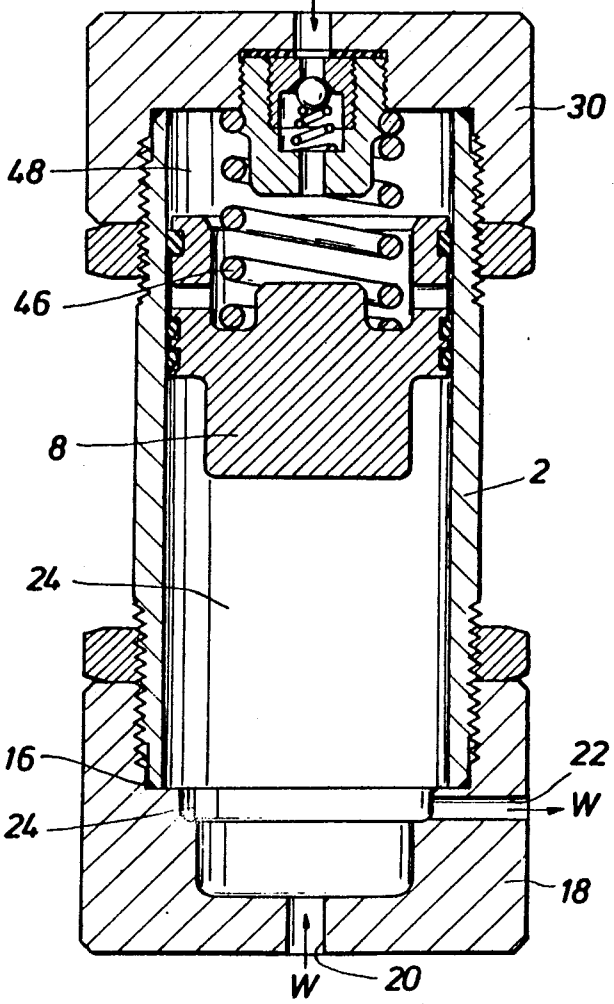
FIG. 2 is a second cross-sectional view of the preferred embodiment showing movement of the free-floating piston.

FIG. 2 shows the preferred embodiment of FIG. I with the free-floating piston 8 indexed towards the top of cylinder 2. This occurs when the water entering through inlet 20 builds up a sufficient pressure within water chamber 24 to overcome force exerted on the piston 8 by the air pressure within air chamber 48 and the spring 46, thereby driving the piston 8 upward to the top of cylinder 2. It will be appreciated that while the preferred embodiments of FIG. 1 and 2 illustrate the free-floating piston at its extreme positions, in operation, the piston 8 would be restricted in its travel and would not reach such extreme positions.

When the hydraulic pump piston is at a top or bottom dead point, the compressed air within chamber 48 and the spring 46 operate to force the free-floating piston 8 downward, increasing the hydraulic pressure on the water in water chamber 24, thereby maintaining a relatively constant water pressure. When the hydraulic 10 pump reaches its maximum working pressure, the high pressure water entering through inlet 20 will fill water chamber 24, driving piston 8 to the top of cylinder 2, thereby further compressing the air within air chamber 48 and the spring 46. When the hydraulic piston pumps reaches a dead point, when no pressure is provided, the air pressure within chamber 48 and the spring 46 will overcome the hydraulic force exerted on piston 8, driving the piston 8 downwardly as illustrated in FIG. I. Further, the coiled spring 46, shown in compression in FIG. 2, provides additional motive force to overcome any piston 8 inertia within the cylinder 2.

Figure 3:
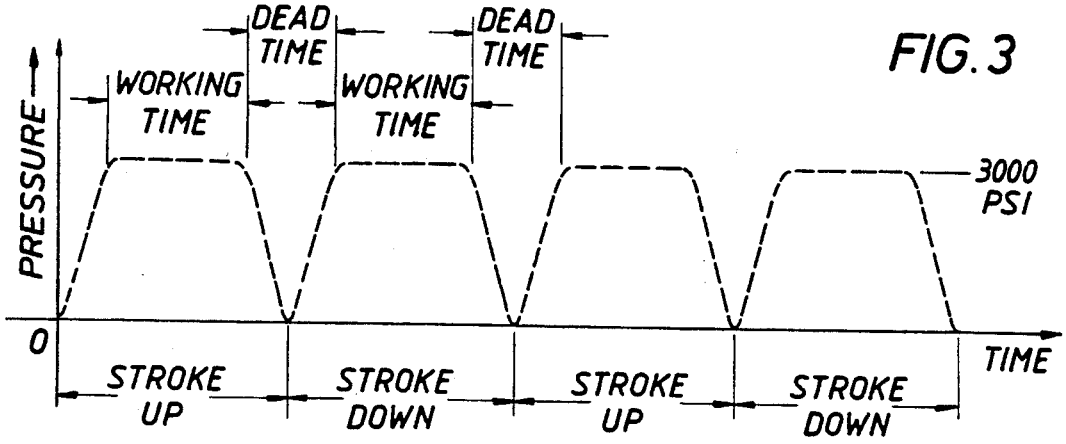
FIG. 3 is a graph of water pressure output from a hydraulic piston pump shown in relation to the pump piston position.

FIG. 3 is a diagram which relates the typical single-action piston hydraulic pump output pressures to time and piston stroke position. A typical piston driven hydraulic pump, such as those illustrated in FIGS. 4 and 6, may begin operation at any point within the stroke length. However, for ease of illustration, the piston stoke is illustrated as beginning at the bottom dead point at time zero. On the stroke up, the working pressure increases until such time as the pump output reaches its desired working pressure. In the diagram of FIG. 3, the desired working pressure is 3,000 psi. The pump output pressure is maintained at the working pressure during the piston travel. However, as the piston begins reaching its top dead point, the working pressure begins dropping until such time as the working pressure has dropped to zero at the piston top dead point.

Figure 6:
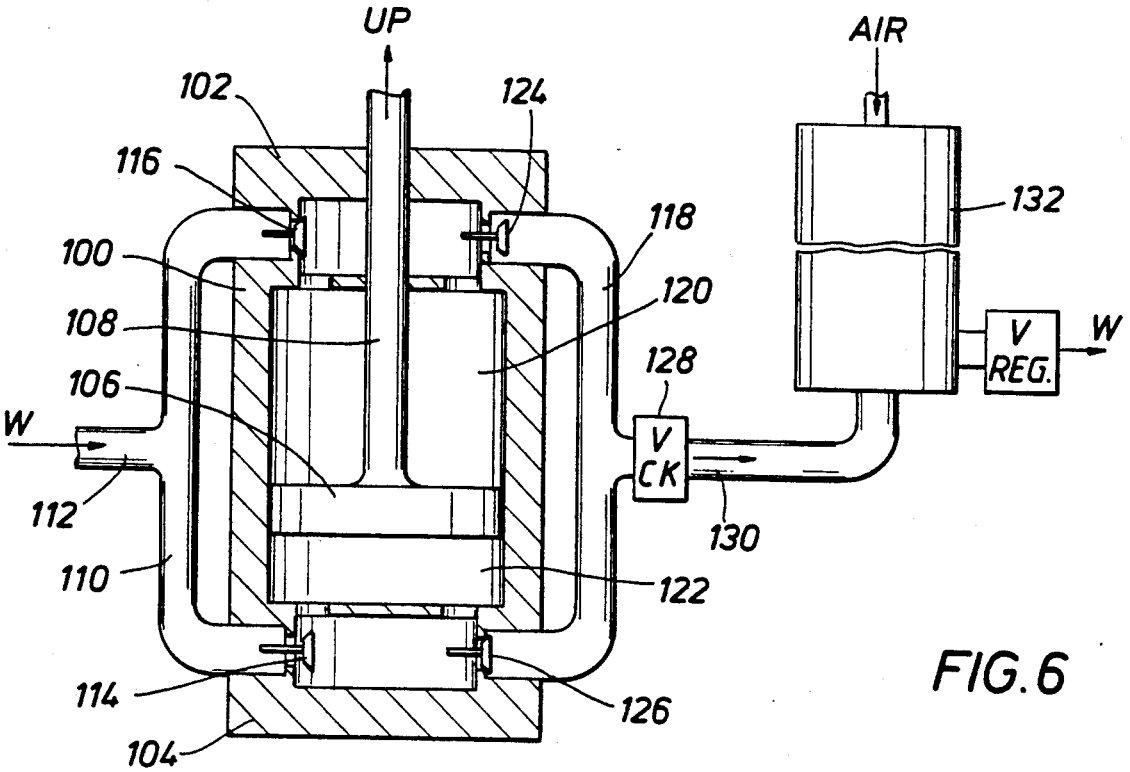
FIG. 6 is a cross-sectional view of a typical double-action hydraulic pump.

On the stroke down, the working pressure again begins to build until such time as it reaches its working pressure. As the piston further traverses downward in the cylinder, the pressure begins to drop until such time as the piston reaches its bottom dead point and pressure drops to zero. The piston then begins its next cycle with its upward movement and the pressure once again rises until it reaches its working pressure of 3,000 psi. The time between the drop in the working pressure and its return to the working pressure is referred to as the dead time. The period of time in which the output pressure of the pumps of FIGS. 4 and 6 is maintained at a relatively constant output pressure is referred to as the pump working time.

Figure 4:
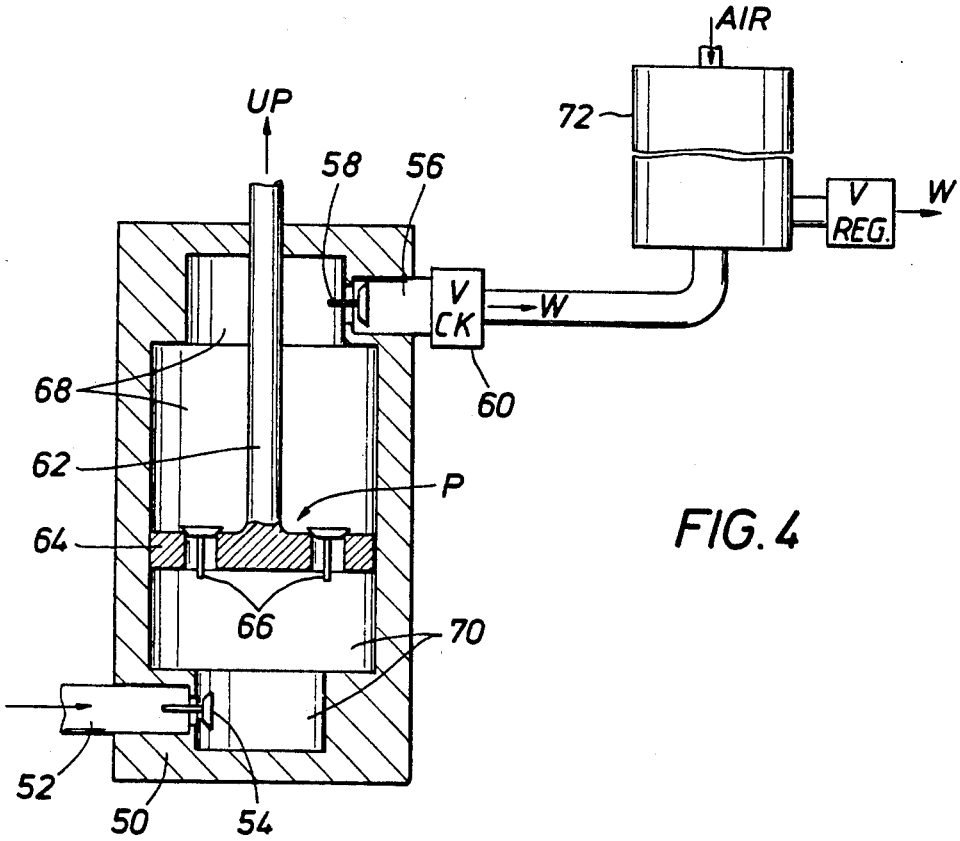
FIG. 4 is a cross-sectional view of a piston driven hydraulic pumping system.

FIG. 4 is a cross-sectional view of a single action hydraulic piston pump of the type generally known in the art which produces the pressure output diagram of FIG. 3. The piston pump is comprised of a pump body 50, having a water inlet 52 and inlet valve 54 and a water outlet 56 and outlet valve 58. The exemplary pump of FIG. 4 further includes a check valve 60 connected to water outlet. The pressure in the hydraulic pump of FIG. 4 is generated by means of a piston P which is comprised of a piston shaft 62 and piston face 64. The piston face 64 further includes a plurality of valves 66 located in piston face 64. In the pump of FIG. 4, the piston P is drawn upwardly by a force exerted on piston shaft 62. The force may be exerted by means of an air motor, internal combustion engine or other commonly known mechanical means. As the piston P is drawn upward, the piston face 64 exerts pressure on water within chamber 68. The hydraulic pressure within chamber 68 opens valve 58, which provides an outlet for the pressurized water through outlet 56 and check valve 60. At the same time, the piston face 64 draws a vacuum, opening valve 54 and thereby drawing water through inlet 54 into chamber 70. When the piston P is at the top of its stroke, no work is being performed. As the piston P is indexed downwardly, it automatically opens the valves 66 in the piston face 64, thereby permitting the water in chamber 70 to flow into chamber 68. At the same time, the pressure in chamber 70 forces valve 54 closed.

The output from check valve 60 of FIG. 4 is connected to the compensator 72 of FIGS. 1 and 2. The compressed water pushes the free-floating piston 8 (FIGS. 1, 2) upwards which compresses the air within air chamber 48 and compresses spring 46 until the hydraulic pressure in water chamber 24 is equal to the pressure exerted on the piston by the compressed air in chamber 48 and the compressed spring 46. When pump piston 64 in FIG. 4 reaches the bottom dead point, the pressure provided by the pump of FIG. 4 is essentially zero. The compressed air within chamber 48 and the spring 46 operate to push the floating piston 8 downwardly which forces water from water chamber 24 and closes check valve 60 (FIG. 4), thereby maintaining hydraulic output pressure. The closing of the check valve 60 results in a very slight pressure loss. Thus, the compensator FIGS. 1 and 2 is capable of providing constant water pressure at 3,000 psi plus or minus 100 psi. It will be appreciated that during its operation, the floating piston 8 of FIGS. 1 and 2 never reaches the bottom dead point of cylinder 2. The length of the stroke of free-floating piston 8 depends on the water pressure created by pump of FIG. 4, the quantity of water supplied by the pump during the stroke, and the length and dead time of the hydraulic pump.

The water exiting the compensator 72 (FIG. 4) enters a pressure regulating valve V which is set to a level less than the nominal working pressure of the pump. By setting the valve V to a pressure level less than the nominal working level, the water exiting pressure regulating valve V does not see an appreciable drop in pressure from the water exiting the compensator 72. The high pressure water may be utilized for a number of applications including sand blasting applications.

Figure 5:
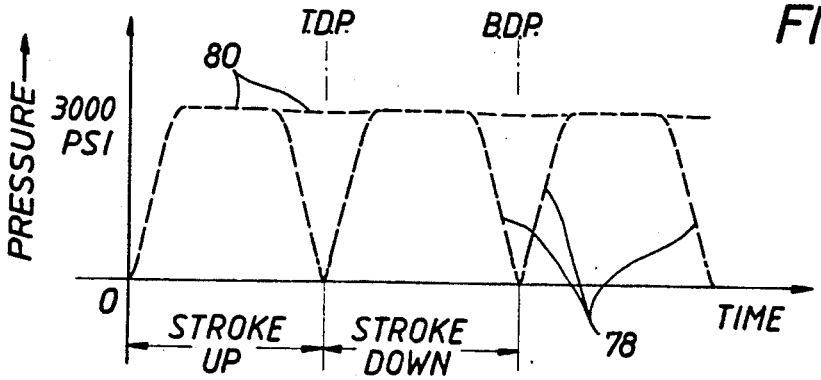
FIG. 5 is a graph of the pressure output of the pump of FIG. 4 in relation to the piston position.

FIG. 5 is a graph showing the hydraulic pressure output of the pump of FIG. 4 without and with the preferred embodiment of FIGS. I and 2. In FIG. 5, the pump of FIG. 4 begins with the piston P at its bottom dead center at times zero. As the piston P is indexed upwardly, the pressure increases until the pump reaches its working pressure, in this case 3,000 psi. The pump of FIG. 4 maintains its working pressure at 3,000 psi as the piston P continues to move upwardly. However, as the volume of water in chamber 68 decreases, the pressure output of the pump of FIG. 4 also decreases until it reaches zero at the top dead point indicated as TDP in FIG. 5 of the piston travel. As the piston P of FIG. 4 begins its downward travel, the working pressure begins to build until it reaches its desired level of 3,000 psi. As the piston is nearing its bottom dead point, the loss of water volume results in a drop-off of water pressure, as shown by line 78, until such time as the output pressure from the pump of FIG. 4 reaches zero at bottom dead point. This cycle continues to repeat as the pump piston of FIG. 4 reciprocates.

The dotted line 80 in FIG. 5 illustrates the hydraulic pressure output of the system which includes the pump of FIG. 4 and the pressure compensator of FIGS. 1 and 2. At time zero, the piston P of FIG. 4 is beginning its upward travel building the working pressure to the 3,000 psi output. As the piston P of FIG. 4 reaches its working pressure level, the free-floating piston 8 of FIG. 1 is indexed toward the top of the cylinder 2, as illustrated in FIG. 2, at which time the force of the compressed air in chamber 48 and compressed spring 46 is equal to the 3,000 psi water pressure maintained in water chamber 24. As the piston P of the pump of FIG. 4 approaches its top dead point, the output pressure from the pump of FIG. 4 begins to decrease. The force exerted by the compressed air in chamber 48 and the spring 46 on the free-floating piston 8 of FIGS. 1 and 2 is then greater than the output pressure of the pump of FIG. 4 and the free-floating piston 8 is indexed downwardly, shutting the check valve 60 (FIG. 4) and exerting pressure on the water within water chamber 24, which exits through the outlet 22 of FIGS. 1 and 2.

This is reflected in FIG. 5 in the slight drop in pressure from the 3,000 psi working pressure indicated at the top dead point in time. As the piston P of FIG. 4 begins its downward movement, the hydraulic pressure again begins to build, opening check valve 60 (FIG. 4) and water enters through inlet 20 into water chamber 24 (FIGS. 1 and 2). The hydraulic pressure in water chamber 24 continues to build until it exceeds the pneumatic pressure within chamber 48, thereby indexing the free-floating piston 8 upwardly to the top of the cylinder 2. As the piston 8 begins to reach its bottom dead center, the hydraulic output from the pump of FIG. 4 begins to drop again and the hydraulic pressure within water chamber 24 is exceeded by the combined air pressure within air chamber 48 and the compressed spring 46 . This indexes the free-floating piston 8 downward, closing check valve 60 and maintaining the working pressure for the fluid exiting outlet 22.

Thus, the hydraulic outlet of a pump of the type shown in FIG. 4 may be maintained at a relatively constant level when used in conjunction with the compensator of FIGS. 1 and 2. Further, a pressure regulator valve V (FIG. 4) may be connected to the outlet 22 of the compensator 72 and set to a pressure level lower than the pump output working pressure. The output pressure from the pressure valve V may be set to compensate for the slight pressure loss from the nominal working pressure, which occurs when the compensator piston 8 is in motion. Thus, the pressure valve may be used to maintain a consistent hydraulic pressure output from the pump of FIG. 4. The preferred embodiment of FIGS. 1 and 2 has been shown operating in conjunction with a single action hydraulic piston pump of the type shown in FIG. 4. However, it Will be appreciated that the compensator of FIGS. 1 and 2 may be used in conjunction with other types of rotary or piston pumps including, the double action piston pump as illustrated in FIG. 6.

FIG. 6 is a cross-sectional view of a double-action piston driven hydraulic pump in combination with the present invention. The pump of FIG. 6 is comprised of a pump body 100, with a pump top 102 and pump bottom 104 and having a piston 106 and piston rod 108 positioned therein. The pump of FIG. 6 includes a low pressure manifold 110 which is connected to a water supply 112 and supplies water to the pump through inlet valves 114 and 116. The pump of FIG. 6 also includes a high pressure outlet manifold 118. The low pressure water entering the valve body 100 flows into the volumes 120 and 122 above and below the piston 106, respectively. As the piston rod 108 and piston 106 are indexed upwardly, the water within volume 120 is compressed, shutting valve 116 and opening high pressure outlet valve 124, and high pressure water flows into high pressure outlet manifold 118. Simultaneously, as the piston 106 is indexed upward a pressure differential in volume 122 opens low pressure inlet valve 114 and closes high pressure outlet valve 126, permitting low pressure water to flow into volume 122.

As the piston rod 10B and piston 106 are indexed downwardly, the piston 106 creates a pressure differential in volume 120, opening valve 116 to permit low pressure water into volume 120. Simultaneously, the piston 106 is compressing the water within volume 122, closing inlet valve 114 and opening high pressure outlet valve 126 which permits high pressure water to flow into the manifold 118. High pressure water is thus supplied through the high pressure manifold 118 with each upward and downward stroke of the pump. The high pressure water passes through a check valve 128 and a conduit 130 into the compensator of the present invention 132, which regulates the output pressure of the pump of FIG. 6. Further, a pressure regulation valve V is illustrated as being connected to the output line of compensator 132. As in FIG. 4, the valve V is set to some pressure lower than the working pressure of the pump, further damping any loss of hydraulic pressure in the system.

Figure 7:
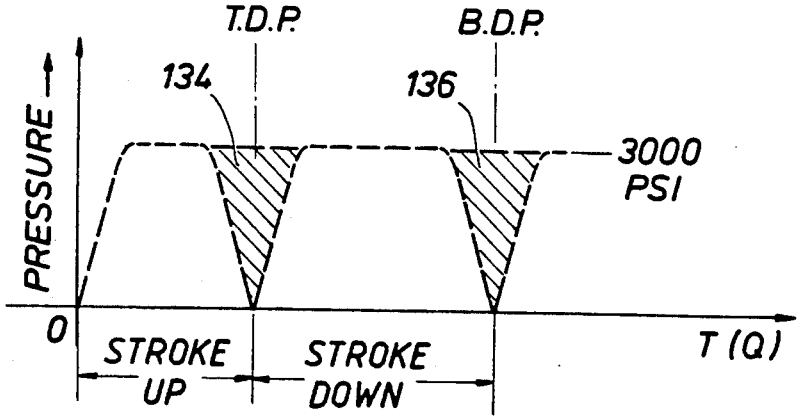
FIG. 7 is a diagram of the pressure output of the pump of FIG. 6 when driven by an air motor.

FIG. 7 is a diagram of the water pressure created by the pump of FIG. 6 when the piston of the pump of FIG. 6 is moved by an air motor. In this instance, the time required for the upstroke of piston rod 108 and piston 106 is shorter than the downstroke time due to the different quantity of water in chamber 120 when compared with the amount of water below the piston in chamber 122. In this instance, when the compensator 132 of the preferred embodiment is connected to the output 130 of the pump of FIG. 6, it will compensate for otherwise dead spots 134 and 136 between the two different piston strokes and keep the pump output at or near the nominal working pressure (3,000 psi).

Figure 8:
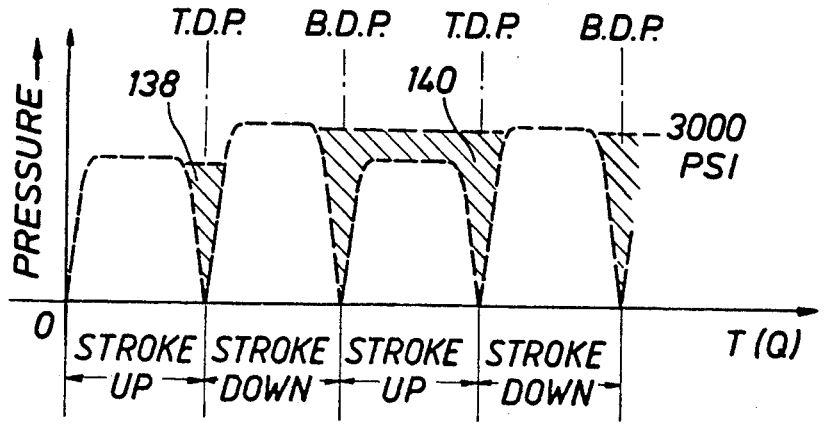
FIG. 8 is a diagram of the pressure output of the pump of FIG. 6 when driven by an electric motor or internal combustion engine.

FIG. 8 is a diagram of the water pressure output created by the pump of FIG. 6 when the piston is activated by means of an electric motor or an internal combustion engine utilizing a linkage which converts the output rotation of the motor or engine into reciprocal movement. In these instances, the time required for the upward and downward strokes of the pistons are equal. However, the output pressure differs between the upward and downward strokes due to the fact that the piston speed is the same in both directions. In this instance, when the compensator of the preferred embodiment is connected to the output of the pump of FIG. 6, it will compensate for the dead spots which result in a drop in pressure 138 and 140 as the piston approaches the top and bottom dead points.

Having described the invention above, various modifications of the techniques, procedures, material and equipment will be apparent to those in the art. It is intended that all such variations within the scope and spirit of the appended claims be embraced thereby.

What I claim is:

1. For use with a high pressure piston driven hydraulic pump having a known working pressure, a hydraulic pressure output compensation system comprised of:

a sealed compensator body, the compensator body further having a high pressure water inlet and check valve means, a high pressure water outlet and a high pressure air inlet;

means for connecting said compensator body to the pump output;

means for connecting said high pressure air inlet to a compressed air source;

a single free-floating piston in said compensator body, said free-floating being sealingly disposed between said high pressure air inlet and said high pressure water inlet and outlet;

means for biasing said free-floating piston toward said high pressure water inlet and said water outlet for overcoming said water pressure within said compensator body when the hydraulic pump working pressure decreases, thereby maintaining hydraulic pressure output from said compensator body.

2. The compensation system of claim 1 further including a pressure regulator connected to said compensator body water outlet, said pressure regulator being set to less than the working pressure of the pump.

3. The compensation system of claim 1, wherein said means for biasing said free-floating piston toward said high pressure water inlet and outlet includes compressed air supplied through said high pressure air inlet.

4. The compensation system of claim 3, wherein said means for biasing said free-floating piston toward said high pressure water inlet and outlet further includes a spring adjacent to said high pressure air inlet.

5. The compensation system of claim 1, wherein said high pressure air inlet further includes an air check valve.

* * * * *